US005393238A

United States Patent [19]

Saito

[11] Patent Number: 5,393,238

[45] Date of Patent: Feb. 28, 1995

[54] LEVER-ACTUATED CONNECTOR ASSEMBLY

[75] Inventor: Masashi Saito, Yokkaichi, Japan

[73] Assignee: Sumitomo Wiring Systems, Ltd., Yokkaichi, Japan

[21] Appl. No.: 98,894

[22] Filed: Jul. 29, 1993

[30] Foreign Application Priority Data

Sep. 18, 1992 [JP] Japan ..... 4-065230[U]

[51] Int. Cl.[6] ..... H01R 13/629

[52] U.S. Cl. ..... 439/157

[58] Field of Search ..... 439/153, 157, 159, 160

[56] References Cited

U.S. PATENT DOCUMENTS

| | | | |
|---|---|---|---|
| 5,135,410 | 8/1992 | Kawase et al. | 439/372 |
| 5,257,942 | 11/1993 | Taguchi | 439/153 |
| 5,269,696 | 12/1993 | Okada et al. | 439/160 |
| 5,308,255 | 5/1994 | Yamanashi | 439/157 |

FOREIGN PATENT DOCUMENTS

| | | |
|---|---|---|
| 0459448 | 12/1991 | European Pat. Off. . |
| 2179506 | 3/1987 | United Kingdom . |
| 2260659 | 4/1993 | United Kingdom . |

*Primary Examiner*—Gary F. Paumen

*Attorney, Agent, or Firm*—Sandler Greenblum & Bernstein

[57] ABSTRACT

A lever-actuated connector assembly includes first and second connectors and a generally U-shaped lever rotatably mounted on the first connector. The first connector is of one piece box-like construction and has an opening defined therein. The first connector has a pair of interior side walls opposite to each other, two pins extending outwardly from the respective interior side walls, two protective rear walls extending outwardly from the respective interior side walls, and two protective exterior side walls extending from exterior edges of the respective rear walls in a direction generally perpendicular to the direction in which the rear walls extend. The second connector has a pair of side walls opposite to each other and two pins integrally formed therewith so as to protrude outwardly therefrom. The lever has a pair of spaced arms and two bearing holes defined therein to receive the bearing pins of the first connector for angular movement between engaged and disengaged positions about a common axis of the bearing pins. When the lever is operated to join the first and second connectors together, the arms of the lever are inserted into associated gaps defined between the interior side walls and the exterior side walls of the first connector, thereby preventing an accidental removal of the arms of the lever from the first connector.

3 Claims, 3 Drawing Sheets

LEVER-ACTUATED CONNECTOR ASSEMBLY

BACKGROUND OF THE INVENTION

1. Field of the Invention

The present invention relates to a lever-actuated electrical connector designed to provide better protection against an undesirable deformation of a lever during rotation thereof and, also, against an accidental removal thereof from a housing.

2. Description of the Prior Art

In a multi-pole connector assembly including a female or socket connector and a mating male or plug connector having twenty terminals or more, it is known that a relatively large operating force is required to connect the plug and socket connectors together. Because of this, the connector assembly in which a lever is employed on either the plug connector or the socket connector has been proposed. With this lever-actuated connector assembly, connection of the plug and socket connectors together is achieved by the application of a relatively small operating force to the lever as the latter operates under the principle of leverage.

FIG. 7 depicts such a conventional lever-actuated connector assembly which comprises a plug connector 12 and a socket connector 11 having a lever 13 rotatably mounted thereon. The socket connector 11 is of one-piece box-like construction and has a bottom wall 11*a*, a pair of side walls 11*b* extending upwardly from respective sides of the bottom wall 11*a*, and two pins 14 extending outwardly from the respective side walls 11*b*. Each of the side walls 11*b* has a notch 11*d* defined therein. The lever 13 has a pair of arms 13*b* spaced away from and parallel to each other and a connecting bar 13*c* integrally formed with the arms 13*b* so as to represent generally the shape of a figure "U". The lever 13 has two holes 13*d* defined in the arms 13*b*, respectively, for engagement with the associated pins 14 of the socket connector 11. The lever 13 also has two guide grooves 13*a* defined on associated interior surfaces of the arms 13*b*. The plug connector 12 has a pair of side walls 12*a* spaced away from and parallel to each other and two guide pins 15 extending outwardly from the respective side walls 12*a*. Both the side walls 12*a* and guide pins 15 are integrally formed with each other.

When the socket and plug connectors 11 and 12 are desired to be joined together, the plug connector 12 is mounted onto the socket connector 11 with the guide pins 15 guided into the guide grooves 13*a* of the lever 13 and then partially into the notches 11*d* of the socket connector 11. Subsequent rotation of the lever 13 in a first direction draws the plug connector 12 deep into the socket connector 11 to complete the connection of the two connectors 11 and 12 together. Removal of the plug connector 12 from the socket connector 11 is achieved by rotating the lever 13 in a direction opposite to the first direction.

However, the connection of the two connectors 11 and 12 occasionally requires a relatively large operating force to be applied to the lever 13. More specifically, rotation of the lever 13 brings about a relatively large friction force between the guide grooves 13*a* of the lever 13 and the guide pins 15 of the plug connector 12. This friction force has the effect of impeding smooth sliding motion of the guide pins 15 along the associated guide grooves 13*a*, and hence, a relatively large load is inevitably applied to the connecting bar 13*c* of the lever 13 in a direction shown by an arrow X, thereby bending the connecting bar 13*c*. As a result, the problem arises that the bending of the connecting bar 13*c* deforms or extends the arms 13*b* of the lever 13 outwardly from the associated guide pins 15.

Furthermore, deformation of the lever 13 prevents maximized utilization of the operating force, thus preventing easy manipulation of the lever 13 when the two connectors 11 and 12 are joined together. If the amount of deformation is large, there is a possibility of the arms 13*b* of the lever 13 separating from the pins 14 of the socket connector 11.

SUMMARY OF THE INVENTION

The present invention has been developed to overcome the above-described disadvantages.

It is accordingly an object of the present invention to provide an improved lever-actuated connector assembly whereby a lever thereof can be manipulated with a relatively small operating force, while preventing a pair of arms of the lever from extending outwardly during rotation of the lever.

Another object of the present invention is to provide a lever-actuated connector assembly of the above-described type which has a simple structure and can be readily manufactured at a low cost.

In accomplishing the above and other objects, a lever-actuated connector assembly according to the present invention comprises a first connector having an opening defined therein and also having a pair of first side walls opposite to each other and on respective sides of the opening, the first side walls having respective bearing pins formed integrally therewith so as to protrude outwardly therefrom, and a second connector having a pair of second side walls opposite to each other, the second connector being undersized relative to the first connector thereby to permit the second connector to be selectively received in and removed out from the first connector through the opening in the first connector, the second side walls having respective pins integrally formed therewith so as to protrude outwardly therefrom. The connector assembly further comprises a generally U-shaped lever having a pair of spaced arms having respective bearing holes defined therein. The lever is rotatably mounted on the first connector with the bearing pins engaged in the bearing holes for angular movement between engaged and disengaged positions about a common axis of the bearing pins. The connector assembly also comprises protective wall means defined in the second side walls for avoiding a disengagement of the arms from the bearing pins during a rotation of the lever between the engaged and disengaged position.

Preferably, the protective wall means is integrally formed with the first connector. In this case, the first connector with the protective wall means has an interior bottom wall, a pair of interior side walls extending upwardly from respective side edges of the interior bottom wall, two pins extending outwardly from the respective interior side walls, two protective rear walls extending outwardly from the respective interior side walls, and two protective exterior side walls extending from exterior edges of the respective rear walls in a direction generally perpendicular to the direction in which the protective rear walls extend.

Advantageously, the protective- exterior side walls are positioned at a specific location in the proximity of the associated bearing pins of the lever and opposite to the side at which the first connector receives the second connector when the both are to be connected together. Because each protective wall comprised of the rear wall and the exterior side wall opens at upper, lower, and front sides thereof, the arms of the lever are introduced in between the interior side walls and the exterior side walls when the lever is manipulated to couple the two connectors together, thereby preventing an accidental removal of the arms from the first connector.

Preferably, the first connector further has two protective exterior bottom walls extending outwardly from respective side edges of the interior bottom wall and continued to associated bottom edges of the exterior side walls. In this case, when the lever is in its disengaged position, a bottom edge of each of the arms is vertically spaced a small distance away from an upper edge of each of the exterior side walls. This arrangement facilitates a mounting operation of the lever onto the first connector.

According to the connector assembly of the present invention, when the lever is manipulated to couple the two connectors together, the arms thereof are inserted into associated gaps between the interior side walls and the exterior side walls. Accordingly, an undesirable deformation of the lever such as an outward extension of the arms thereof, which has hitherto been caused in the conventional connector assembly, can be prevented by the exterior side walls. As a result, not only the operating force applied to the lever is effectively utilized to join the two connectors together, but also an accidental removal of the lever from the first connector can be assuredly prevented.

BRIEF DESCRIPTION OF THE DRAWINGS

The above and other objects and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
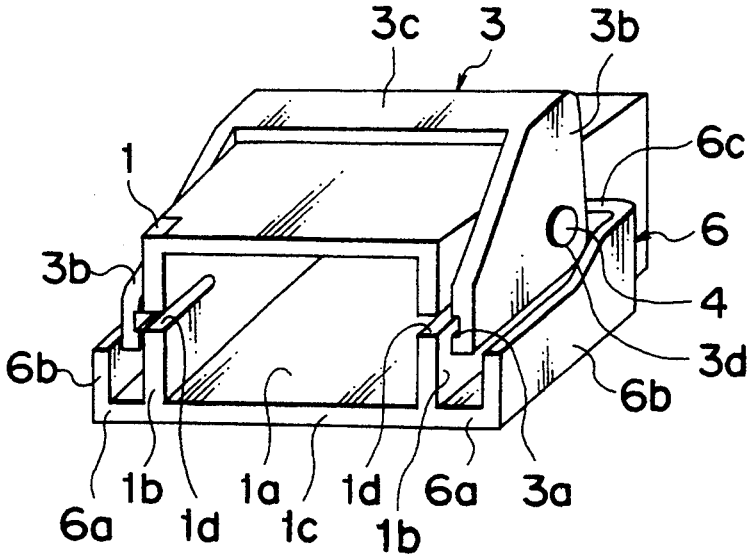
FIG. 1 is a perspective view of a socket connector of a lever-actuated connector assembly according to a first embodiment of the present invention.
Figure 2:
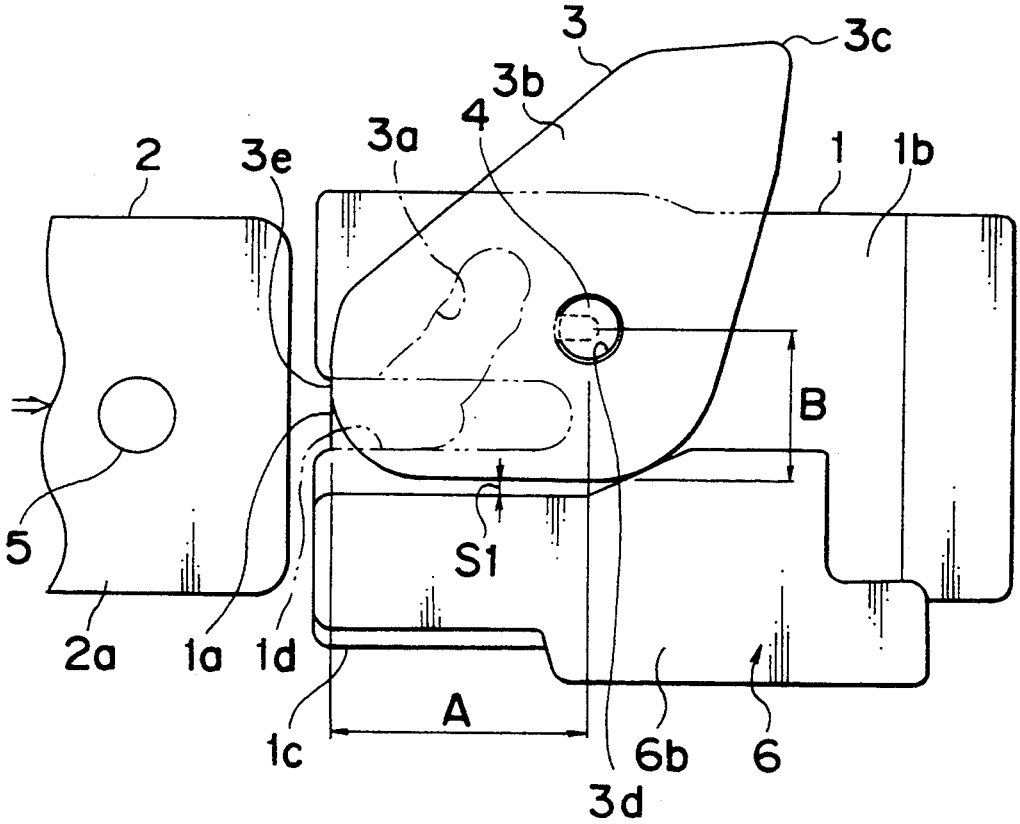
FIG. 2 is a side view of the connector assembly before engagement of socket and plug connectors.

Referring now to the drawings, there is shown in FIGS. 1 and 2 a lever-actuated connector assembly according to a first embodiment of the present invention. The connector assembly comprises a plug or male connector 2 and a socket or female connector 1 having a lever 3 rotatably mounted thereon.

The socket connector 1 is of one-piece box like construction and has an opening 1*a* for receiving the plug connector 2. The socket connector 1 has an interior bottom wall 1*c*, a pair of side walls 1*b* extending upwardly from respective sides of the interior bottom wall 1*a*, and two bearing pins 4 extending outwardly from the respective side walls 1*b*. Each of the side walls 1*b* has a generally horizontally extending guide groove 1*d* defined therein so as to extend in a direction generally parallel to the bottom wall 1*a*. The socket connector 1 further has two protective walls 6 formed on respective sides thereof. Each of the protective walls 6 comprises an exterior bottom wall 6*a* extending outwardly from the interior bottom wall 1*c*, an exterior side wall 6*b* extending upwardly from an exterior side of the exterior bottom wall 6*a*, and a rear wall 6*c* extending upwardly from a rear end of the exterior bottom wall 6*a*. The rear wall 6*c* is continued to both of a rear end of the interior side wall 1*b* and that of the exterior side wall 6*b*.

The lever 3 has a pair of arms 3*b* spaced away from and parallel to each other and a connecting bar 3*c* integrally formed with the arms 3*b* so as to render the lever 3 to represent the shape of a figure "U". The arms 3*b* have round bearing holes 3*d* defined therein for engagement with the respective pins 4 of the socket connector 1 and guide grooves 3*a* defined on associated interior surfaces thereof for guiding the plug connector 2 when the plug connector 2 is coupled with the socket connector 1 with the pins 3 slidingly engaged therein. The lever 3 can rotate, about a common axis of the pins 4 of the socket connector 1, between its engaged position, in which the two connectors 1 and 2 can be securely coupled with each other, and its disengaged position in which the plug connector 2 can be removed from the socket connector 1.

As best shown in FIG. 2, when the lever 3 is in the disengaged position, a front edge 3*e* and a bottom edge of each of the arms 3*b* are spaced a distance A and a distance B from the center of the hole 3*d*, respectively, the distance A being greater than the distance B. When the lever 3 is in this position, the bottom edge of each of the arms 3*b* is vertically spaced a small distance S1 away from an upper edge of each of the exterior side walls 6*b*.

The plug connector 2 has a pair of opposite side walls 2*a* and two guide pins 5 integrally formed with and extending outwardly from the respective side walls 2*a*. The plug connector 2 is undersized relative to the socket connector 1 so as to be selectively received in and removed out from the socket connector 1 through the opening 1*a*.

When the plug connector 2 is coupled with the socket connector 1, entering through the opening 1*a* of the latter, the two guide pins 5 of the former are introduced into both the associated guide grooves 1*d* of the latter and the associated guide grooves 3*a* of the lever 3. Subsequent rotation of the lever 3 from the disengaged position towards the engaged position allows the guide pins 5 of the plug connector 2 to slide along the guide groove 3*a* of the lever 3 with the plug connector 2 drawn deep into the socket connector 11. Removal of the plug connector 2 from the socket connector 1 is achieved by rotating the lever 3 in a direction reverse to that described above, i.e., from the engaged position towards the disengaged position.

Figure 3:
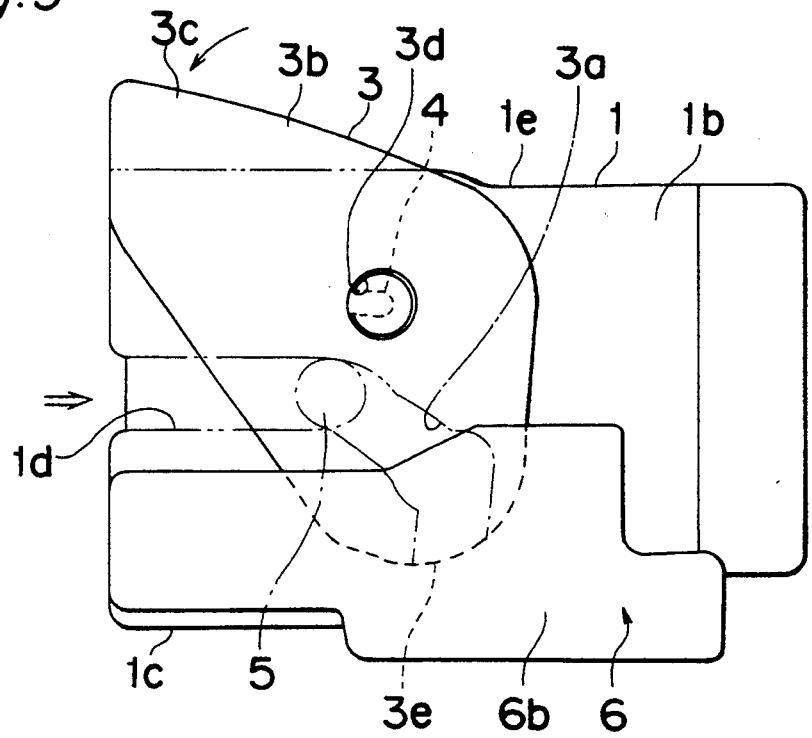
FIG. 3 is a side view of the connector assembly after the engagement.

FIG. 3 depicts the condition in which the two connectors 1 and 2 are securely coupled with each other. In this condition, the edges 3*e* of the arms 3*b* of the lever 3 is assuredly received into associated gaps, each defined between the interior side wall 1*b* and the exterior side wall 6*b* of the socket connector 1, because of the distance A greater than the distance B as mentioned previously.

According to the first embodiment of the present invention discussed above, when an operating force is applied to the connecting bar 3c of the lever 3 to rotate the lever 3 from the disengaged position towards the engaged position, the exterior side walls 6b of the socket connector 1 prevent the arms 3b of the lever 3 from being outwardly bent about associated joints between the arms 3b and the connecting bar 3c. Because the exterior side walls 6b are continued to the interior side walls 1b via the rear walls 6c for reinforcement thereof, the exterior side walls 6b are not deformed even though a friction force acts between the lever 3 and the exterior side walls 6b so as to urge the latter outwardly during the rotation of the lever 3.

Furthermore, when the lever 3 is in the disengaged position, the bottom edge of each of the arms 3b is vertically spaced a small distance of S1 away from the upper edge of each of the exterior side walls 6b. Because of this, the arms 3b of the lever 3 do not interfere with the exterior side walls 6b during a lever mounting operation in which one of the arms 3b of the lever 3 is initially engaged with one of the pins 4 of the socket connector 1 and the other arm 3b is subsequently engaged with the other pin 4 by extending it outwardly. Accordingly, the mounting operation of the lever 3 on the separate socket connector 1 can be readily carried out.

Figure 4:
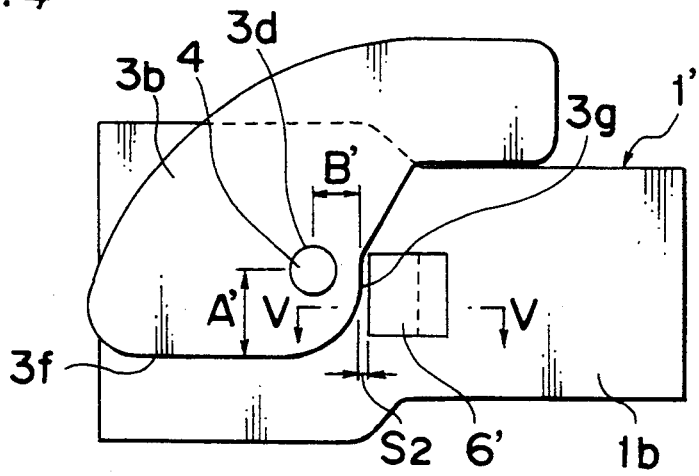
FIG. 4 is a side view of a socket connector of a lever-actuated connector assembly according to a second embodiment of the present invention.

FIG. 4 depicts a socket connector 1' of a lever-actuated connector assembly according to a second embodiment of the present invention. The connector assembly of the second embodiment differs from that of the first embodiment in respect of the position and the size of the protective walls shown by 6 in FIG. 2 or by 6' in FIG. 4. As shown in FIG. 4, the protective walls 6' are smaller than the protective walls 6, thus contributing to miniaturization of the connector assembly.

Figure 5:
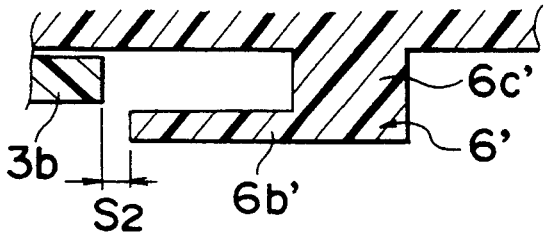
FIG. 5 is a cross-sectional view taken along line V—V in FIG. 4.

According to the second embodiment shown in FIG. 4, each of the protective walls 6' comprises a rear wall 6c' extending outwardly from the interior side wall 1b and an exterior side wall 6b' extending forwardly from an exterior edge of the rear wall 6c' in a direction generally perpendicular to the direction in which the rear wall 6c' extends. As best shown in FIG. 5, both the exterior side wall 6b' and the rear wall 6c' are integrally formed with the socket connector body and generally take the form of a figure "L", as viewed from above. The width of a gap defined between the exterior side wall 6b' and the interior side wall 1b is so chosen as to be slightly wider than the thickness of the arms 3b of the lever 3.

When the lever 3 is in the disengaged position shown in FIG. 4, bottom and rear edges 3f and 3g of each of the arms 3b thereof are spaced a distance A' and a distance B' from the center of the hole 3d, respectively, the distance A' being greater than the distance B'. In this position, the rear edge 3g of the lever 3 is spaced a small distance S2 away from a front edge of the exterior side wall 6b' of the protective wall 6'.

Figure 6:
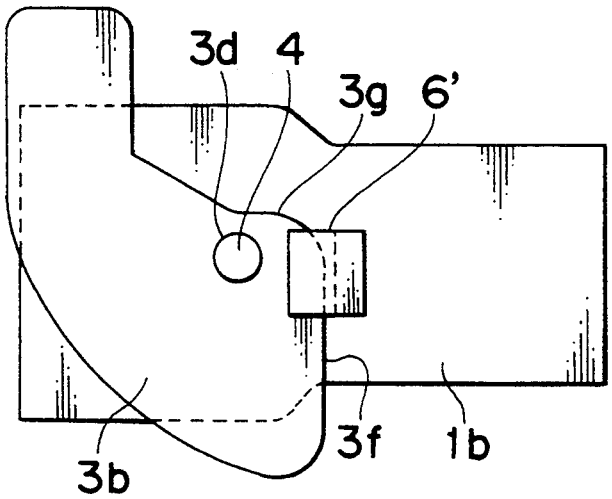
FIG. 6 is a side view of the socket connector of FIG. 4 when a lever rotatably mounted thereon is in its engaged position.
Figure 7:
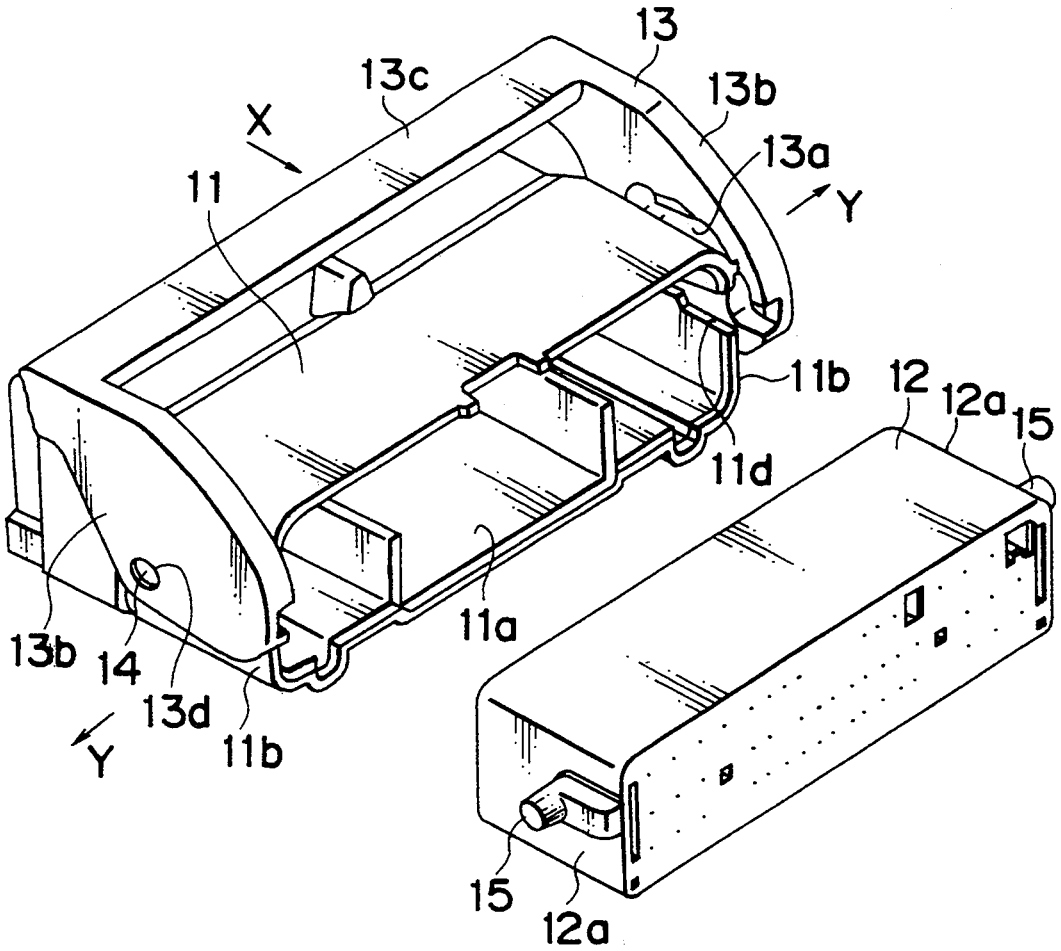
Fig.7 PRIOR ART
FIG. 7 is a perspective view of a conventional lever-actuated connector assembly.

Because the protective wall 6 opens at upper, lower, and front sides thereof and because the lever 3' is so configured as to represent A'>B', when the socket connector 1 and the plug connector 2 are joined together, the arms 3b of the lever 3 are introduced from below into the associated gaps between the exterior side walls 6b' and the interior side walls 1b until the lever 3 reaches the engaged position shown in FIG. 6.

As is the case with the first embodiment, when a load is applied to the lever 3 in attempt to rotate the latter, the protective walls 6' prevent the arms 3b thereof from being outwardly bent about associated joints between the arms 3b and the connecting bar 3c. Furthermore, because the rear end 3g of each of the arms 3b of the lever 3 is slightly spaced from the front end of the associated protective wall 6', the mounting operation of the lever 3 on the separate socket connector 1' can be readily carried out.

The configuration of the protective walls is not limited to that discussed above, and it is sufficient if the arms 3b of the lever 3 can be partially inserted in between the interior side walls and the exterior side walls when the socket connector 1 and the plug connector 2 are coupled with each other.

As is clear from the above, according to the present invention, when the lever is operated, portions thereof are inserted in between the interior side walls and the exterior side walls. Accordingly, the lever is not subjected to an undesirable deformation such as, for example, the outward extension of the arms thereof, which has hitherto been caused during the rotation thereof in the conventional connector assembly. Therefore, it never happens that the arms of the lever are disengaged from the associated pins of the socket connector.

The conventional connector assembly requires a relatively large operating force to operate the lever due to an undesirable deformation thereof during rotation, whereas in the connector assembly according to the present invention the maximized utilization of the operating force of the lever is possible by preventing the outward extension of the arms of the lever because of the provision of the protective walls. Because all the operating force applied to the lever is used to join the socket and plug connectors together via the guide grooves of the lever and those of the socket connector, the engagement of the socket and plug connectors can be effectively carried out even if a relatively large operating force is required.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A lever-actuated connector assembly comprising:

a first connector having an opening defined therein and also having a pair of first side walls opposite to each other and on respective sides of said opening, said first side walls having respective bearing pins formed integrally therewith so as to protrude outwardly therefrom;

a second connector having a pair of second side walls opposite to each other, said second connector being undersized relative to said first connector thereby to permit said second connector to be selectively received in and removed out from said first connector through said opening in said first connector, said second side walls having respective guide pins integrally formed therewith so as to protrude outwardly therefrom;

a generally U-shaped lever having a pair of spaced arms having respective bearing holes defined therein, and each said bearing hole having a center, each of said spaced arms having a first edge and a second edge, the distance from said first edge to said center being greater than the distance from said second edge to said center, said lever being rotatably mounted on said first connector with said bearing pins engaged in said bearing holes for angular movement between engaged and disengaged positions about a common axis of said bearing pins; and protective wall means on said first connector, said protective wall means being spaced from said first side walls to form associated gaps therebetween, said protective wall means preventing outward disengagement of said arms from said bearing pins during a rotation of said lever between the engaged and disengaged positions, and whereby the arms of said lever are spaced outside of said gaps when said lever is in the disengaged position.

2. A lever-actuated connector assembly comprising:

a first connector having an opening defined therein and also having an interior bottom wall, a pair of interior side walls extending upwardly from respective side edges of said interior bottom wall, two bearing pins extending outwardly from said respective interior side walls, said bearing pins having a common axis, two protective rear walls extending outwardly from said respective interior side walls, and two protective exterior side walls extending from exterior edges of said respective rear walls in a direction generally perpendicular to the direction in which said rear walls extend;

a second connector having a pair of side walls opposite to each other, said second connector being undersized relative to said first connector thereby to permit said second connector to be selectively received in and removed out from said first connector through said opening in said first connector, said side walls having respective guide pins integrally formed therewith so as to protrude outwardly therefrom; and a generally U-shaped lever having a pair of spaced arms having respective bearing holes defined therein, each of said spaced arms having a first edge and a second edge, the distance between said first edge and said common axis being greater than the distance from said second edge to said common axis, said lever being rotatably mounted on said first connector with said bearing pins engaged in said bearing holes for angular movement between engaged and disengaged positions about said common axis of said bearing pins, whereby, when said lever is operated to join said first and second connectors together in said engaged position, said arms of said lever, including said first edge, are rotated into associated gaps defined between said interior side walls and said exterior side walls of said first connector, thereby preventing an accidental removal of said arms of said lever from said first connector, and when said lever is in said disengaged position, said arms of said lever, including said first and second edges, are located outside of said associated gaps.

3. The connector assembly according to claim 2 wherein said first connector further has two protective exterior bottom walls extending outwardly from respective side edges of said interior bottom wall and extending to associated bottom edges of said exterior side walls.

* * * * *